US009718602B2

(12) United States Patent
Draghetti

(10) Patent No.: US 9,718,602 B2
(45) Date of Patent: Aug. 1, 2017

(54) DOUBLE HINGED LID PRODUCT PACKAGE

(71) Applicant: GIMA TT S.R.L., Ozzano dell'Emilia (IT)

(72) Inventor: Fiorenzo Draghetti, Medicina (IT)

(73) Assignee: GIMA TT S.P.A., Ozzano dell'Emilia (IT)

( * ) Notice: Subject to any disclaimer, the term of this patent is extended or adjusted under 35 U.S.C. 154(b) by 60 days.

(21) Appl. No.: 14/351,783

(22) PCT Filed: Oct. 10, 2012

(86) PCT No.: PCT/IB2012/002036
§ 371 (c)(1),
(2) Date: Apr. 14, 2014

(87) PCT Pub. No.: WO2013/054177
PCT Pub. Date: Apr. 18, 2013

(65) Prior Publication Data

US 2014/0367285 A1 Dec. 18, 2014

(30) Foreign Application Priority Data

Oct. 12, 2011 (IT) ..... MI2011A1858

(51) Int. Cl.
*B65D 85/00* (2006.01)
*B65D 85/10* (2006.01)
(Continued)

(52) U.S. Cl.
CPC ..... *B65D 85/1036* (2013.01); *B65D 5/32* (2013.01); *B65D 5/646* (2013.01); *B65D 5/6602* (2013.01); *B65D 85/1045* (2013.01)

(58) Field of Classification Search
CPC ..... B65D 85/1054; B65D 85/1045; B65D 5/6682; B65D 5/6685; B65D 5/6697;
(Continued)

(56) References Cited

U.S. PATENT DOCUMENTS 439,993 A * 11/1890 Bailey ..... 229/121
2,597,810 A * 5/1952 Myers ..... 229/129.1
(Continued)

FOREIGN PATENT DOCUMENTS

CN 201109591 Y 9/2008
CN 201165398 Y 12/2008
(Continued)

OTHER PUBLICATIONS

International Search Report and Written Opinion from PCT/IB2012/002036 mailed Jan. 21, 2013.

*Primary Examiner* — Anthony Stashick
*Assistant Examiner* — Ernesto Grano
(74) *Attorney, Agent, or Firm* — Calfee Halter & Griswold LLP

(57) ABSTRACT

A packet is suitable to contain products in loose or organized form and comprises at least two elements such as a mobile lid, affecting the upper part of the packet, and a containing body. The containing body consists of two lateral, a rear wall, a front wall, an upper wall and a lower wall, all defining a front bulk and a lateral bulk. The elements are connected to each other by movement means. The mobile lid is suitable to assume a closed position and an open position. The mobile lid, the walls of the containing body and the movement means define a kinematic mechanism suitable to make the mobile lid assume an open position as well.

8 Claims, 6 Drawing Sheets

(51) Int. Cl.
*B65D 5/66* (2006.01)
*B65D 5/32* (2006.01)
*B65D 5/64* (2006.01)

(58) Field of Classification Search
CPC .... B65D 5/646; B65D 43/161; B65D 5/6602; A24F 15/12
USPC ..... 206/267, 268, 260, 250, 251, 252, 254, 206/257, 261, 262, 265, 266, 271, 273, 206/276
See application file for complete search history.

(56) References Cited

U.S. PATENT DOCUMENTS 2,990,994 A * 7/1961 Hackmyer ..... 229/129.1
3,311,283 A * 3/1967 Shimada et al. ..... 229/125.08
3,400,874 A * 9/1968 Shimada et al. ..... 206/250
3,858,788 A * 1/1975 Phillips, Jr. ..... 229/125.08
3,899,125 A * 8/1975 Andrews et al. ..... 220/495.01
3,933,299 A * 1/1976 Shimada et al. ..... 229/125.37
3,977,520 A * 8/1976 Grimm ..... 206/270
4,049,117 A * 9/1977 Grimm ..... 206/270
4,267,926 A * 5/1981 Toimil ..... 206/268
4,646,960 A * 3/1987 Challand ..... 206/259
4,887,711 A * 12/1989 Bladt ..... 206/92
8,042,685 B2 * 10/2011 Bourgoin et al. ..... 206/267
8,167,124 B2 * 5/2012 Uesugi et al. ..... 206/267
8,245,841 B2 * 8/2012 Agirbas ..... 206/268
8,281,922 B2 * 10/2012 Chatelain ..... 206/267
2009/0188818 A1 7/2009 Moore et al.
2009/0205982 A1 * 8/2009 Hein et al. ..... 206/251
2009/0242434 A1 * 10/2009 Ghini ..... B65D 85/1045 206/246
2010/0320263 A1 * 12/2010 Tawada ..... B65D 85/1009 229/160.1
2011/0100846 A1 * 5/2011 Collins ..... 206/268
2013/0175189 A1 * 7/2013 Agirbas ..... 206/268
2014/0110286 A1 * 4/2014 Bertuzzi et al. ..... 206/268
2014/0238877 A1 * 8/2014 Petrucci et al. ..... 206/255
2014/0374290 A1 * 12/2014 Seyfferth De Oliveira .. 206/268

FOREIGN PATENT DOCUMENTS

CN 201777567 U 3/2011
WO 2006021581 A1 3/2006
WO 2012028394 A1 3/2012

* cited by examiner

DOUBLE HINGED LID PRODUCT PACKAGE

CROSS-REFERENCE TO RELATED APPLICATION

This application is the U.S. national phase entry of PCT/IB2012/002036, with an international filing date of 10 Oct. 2012, which claims the benefit of Italian Application Serial No. MI2011A001858, with a filing date of 12 Oct. 2011, the entire disclosures of which are fully incorporated herein by reference.

FIELD OF THE INVENTION

The present invention concerns a packet suitable to contain products in loose or organized form, such as for example cigarettes or other smoking articles, tablets, pills or other.

BACKGROUND OF THE INVENTION

When using packets for smoking articles, or packets for loose products in general, there are problems of simplifying the opening thereof, facilitating access to the internal compartment and reducing the bulk.

For example, it is useful to allow the user to use only one hand, at the same time achieving a stable and large open position.

This requirement is connected to the removal of the smoking articles or other loose products, and the nervousness of the user, and also to the fact that the package or packet is often used for depositing possible accessories, such as for example a lighter in the case of smoking articles.

Document JP-A-59060122 is known, which provides that the lid that makes up the upper part of the packet can be moved from the front to the rear with a rotation movement. This rotation occurs around the axis of a hinge disposed on the long rear side of the packet.

This movement can be awkward to execute and the bulk of the packet in the open position is bulky. Moreover, the mobile lid, connected to the rest of the packet by means of a single hinge, is unstable and at risk of breaking.

Document US-A-2010/0320263 is known, which provides an opening mechanism by means of which the whole front part of the package can be moved forward and down. This teaching has the disadvantage, however, of placing limits on the amplitude and stability of the opening of the package and the ease of using it. The opening mechanism comprises two elements hinged on the packet itself and on the mobile part, one at the front and the other at one end of the bottom. In particular, one of the hinges situated on the fixed part is positioned in the central zone of the front wall, while the other hinge is positioned in correspondence to the lower rear corner of the packet. This disposition, during use, allows a substantially rotatory movement of the mobile front part around the axis of the lower hinge, a movement which is uncomfortable and complicated as well as limited. In the open position, the mobile front part, as well as protruding from the front downward with respect to the fixed part, is disposed angled with respect to the latter, in practice creating a narrow and unstable passage, and also occupying a considerable space.

One purpose of the present invention is therefore to obtain a package, of the packet type, for smoking articles or other loose products in general, whose bulk is minimum both in the closed position, so as to be carried easily in a pocket for example, and in the open position, for example to be used and carried in only one hand.

Another purpose of the present invention is to make a package, of the packet type, which has an upper part which can be opened easily so that it is easy to activate and can be placed in an open position that is stable, large and not bulky.

In the state of the art, packages of the packet type are made starting from cardboard blanks, suitably shaped and with lines of folding and/or intended breakage, which allow them to be produced on a wide scale and facilitate production.

To this end, one purpose of the present invention is to reduce the number of blanks needed to make the packet, given the same sizes and shape, and in compliance with the functions and advantages described above.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, a perfected packet according to the present invention is suitable to contain products in loose or organized form, such as for example cigarettes or other smoking articles, tablets, pills or other.

According to a main characteristic of the present invention, the packet comprises at least a lid, which affects the upper part of the packet, and a containing body, movement means being present between the lid and the containing body and made solid therewith; the movement means comprise for example two tabs, consisting of a kinematic mechanism of the articulated quadrilateral type.

In the closed position, the lid covers at least a part of the upper wall of the containing body and at least part of a portion of the front and lateral walls.

The movement means are advantageously both hinged on the same wall of the containing body and are substantially parallel or lying on the same plane when closed.

According to a variant, comprised within the field of the present invention, the movement means are hinged on the high part of the packet, in two different walls of the containing body of the packet, and are orthogonal when closed.

According to one characteristic of the present invention, the hinged sides of the articulated quadrilateral can have equal or different reciprocal lengths.

Advantageously, the lid is made mobile in the final step of packaging and is suitable to be moved, thanks to the articulated quadrilateral, from a closed position to an open position. In the terminal position of the opening movement, called open position, the lid assumes a placement substantially resting on the containing body. This placement, with reference to the containing body, is located lower to the starting position, but in any case around and in close proximity to the front bulk of the packet.

According to a variant, the lid, in this case too made mobile advantageously in the final packaging step, is suitable to be moved, thanks to the articulated quadrilateral, from the closed position, to the open position. In the terminal position of said movement, called open position, the lid assumes a substantially lateral placement with respect to the front bulk of the packet, keeping itself around and in close proximity to the lateral bulk of the packet.

In the above variant, in the closed position, the lid covers at least a part of the upper wall of the containing body and only a portion of the front, lateral and rear walls.

The packet, according to the present invention can provide the positioning, inside the internal cavity of the packet, of a protective wrapper, with the function of protecting the product contained therein from contamination and/or damage deriving from external agents, above all in the steps before sale.

The packet according to the present invention is made starting from blanks, shaped and having lines of folding and/or intended breakage.

DESCRIPTION OF THE DRAWINGS

These and other characteristics of the present invention will become apparent from the following description of two forms of embodiment, given as a non-restrictive example with reference to the attached drawings wherein.

To facilitate comprehension, the same reference numbers have been used, where possible, to identify identical common elements in the drawings.

DESCRIPTION OF SOME FORMS OF EMBODIMENT

A first form of embodiment of the present invention is described hereafter.

Figure 1B:
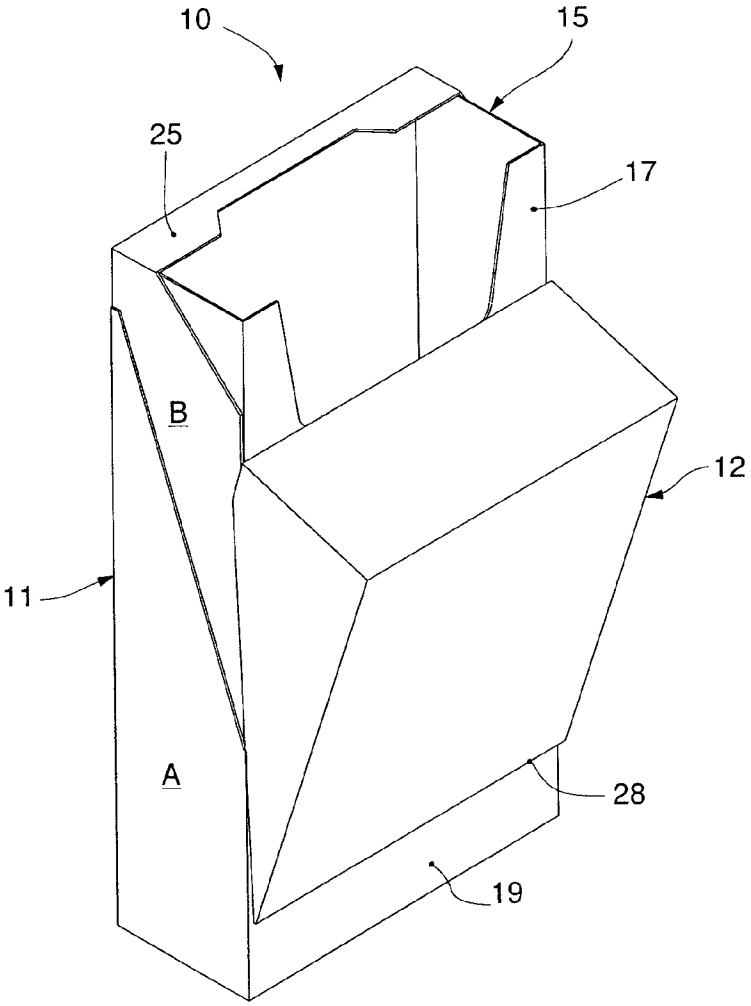
FIG. 1*b* is a three-dimensional view of the packet in FIG. 1*a* in a completely open position.
Figure 1A:
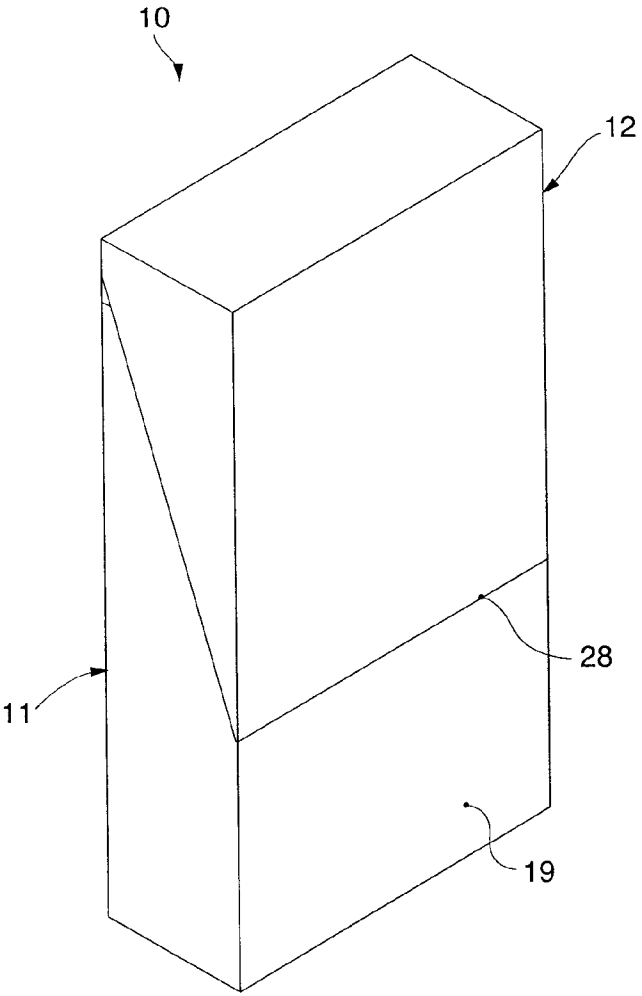
FIG. 1*a* is a three-dimensional view of the packet in the closed position according to a first form of embodiment.

With reference to FIGS. 1*a* and 1*b* a packet 10 suitable to contain material in loose or organized form, such as for example cigarettes or other smoking articles, or tablets, pills or other, comprises a containing body 11, a mobile lid 12, and an internal body 15.

The containing body 11 has a substantially parallelepiped shape, having two lateral walls 16, a rear wall, a front wall 19, an upper wall 25 and a lower wall. In this case the parallelepiped shape of the containing body lacks almost half of its front face, which in this case is identified by a front wall 19. Moreover, the containing body 11 is hollow inside and has the upper wall 25 as its top element.

The mobile lid 12 comprises an internal wall 13 (FIGS. 2*a*-2*c*), which in its turn includes an upper face 14.

Figure 2C:
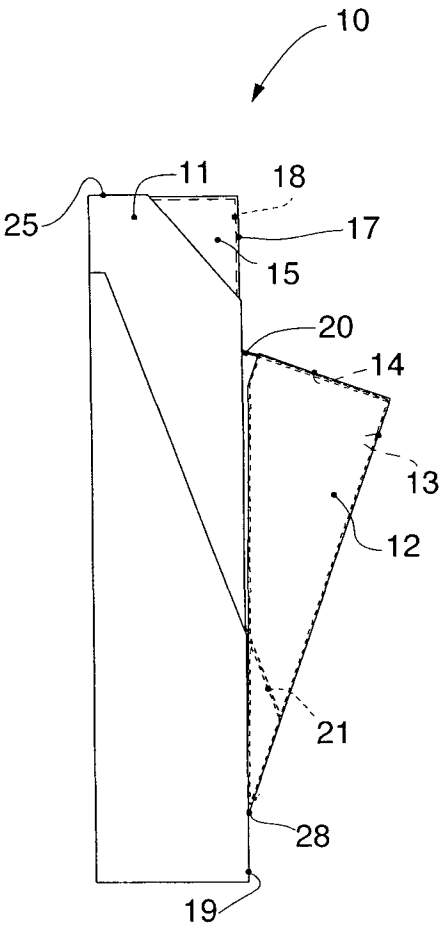
FIG. 2*c* is a lateral view of the packet in FIG. 1*b;*
Figure 2B:
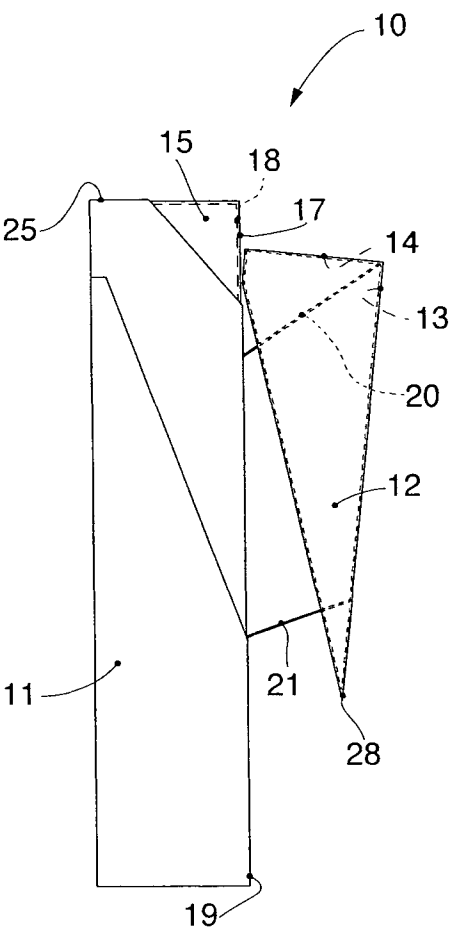
FIG. 2*b* is a lateral view of the packet in FIGS. 1*a*, 1*b* in an intermediate open position.
Figure 2A:
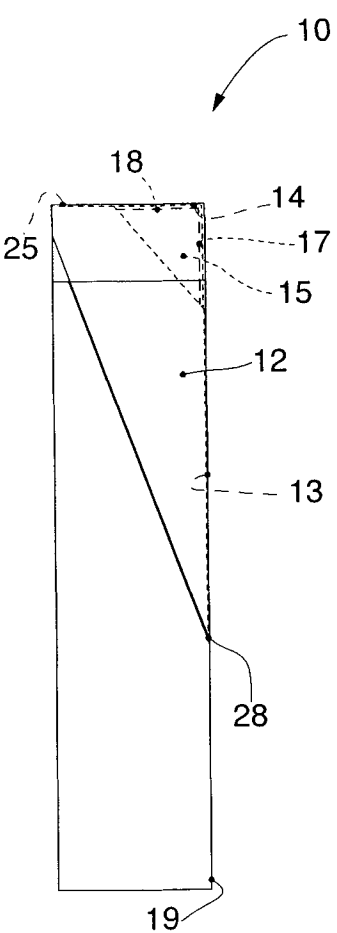
FIG. 2*a* is a lateral view of the packet in FIG. 1*a;*

In FIGS. 1*a* and 2*a*, in which the packet 10 is shown in its closed position, the mobile lid 12 is positioned so that the upper face 14 of its internal wall 13 is coupled to the upper wall 25 of the containing body 11, in this way closing the packet in a complete parallelepiped shape, hollow inside.

With reference to FIGS. 1*b*, 2*b*, 2*c*, the movement of the mobile lid 12 occurs thanks to two tabs, made from a front face 17 of the internal body 15 and referred to as top tab 20 and central tab 21.

Figure 5:
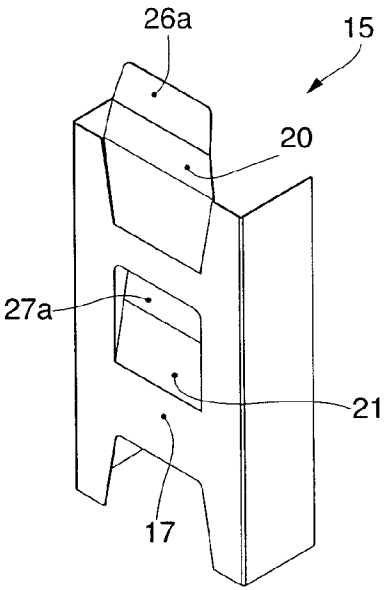
FIG. 5 is a three-dimensional view of the blank in FIG. 4, in condition of use.
Figure 4:
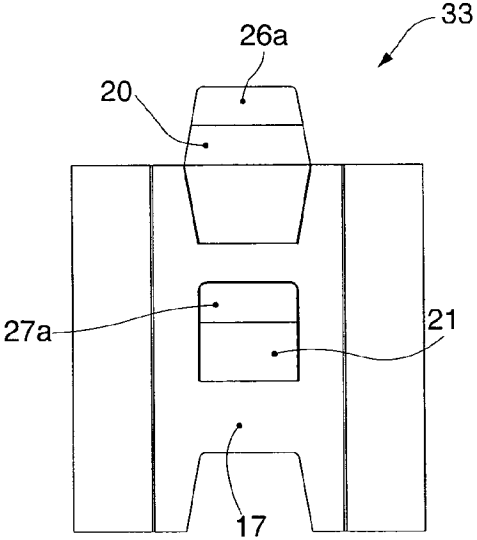
FIG. 4 is a plan view of the second blank to make the packet in FIGS. 1*a* to 2*c;*
Figure 3:
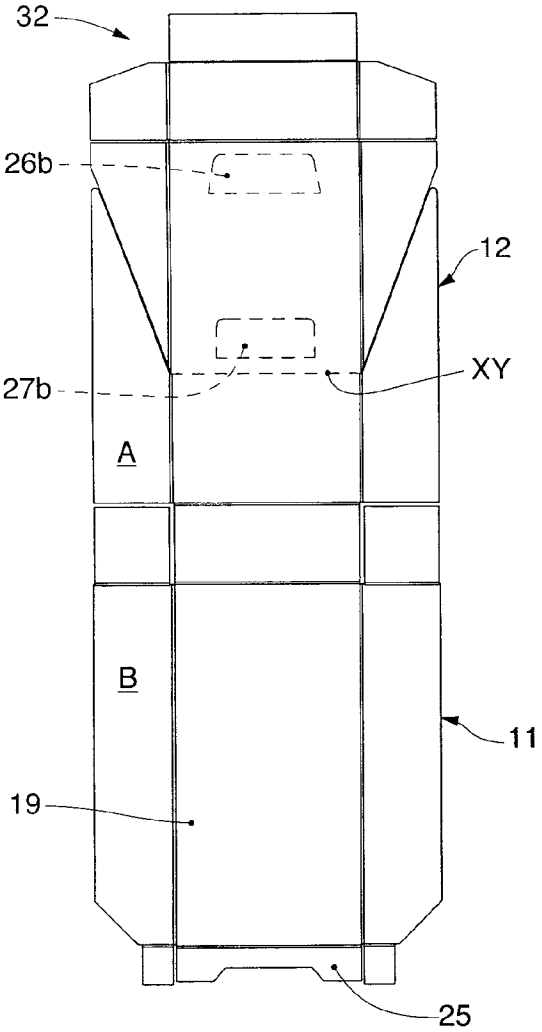
FIG. 3 is a plan view of the first blank to make the packet in FIGS. from 1*a* to 2*c;*

FIGS. 3, 4, 5 show a first blank 32 and a second blank 33 to make the packet 10 and the folding lines and cutting lines and an intended breakage line XY are highlighted, which, once activated, defines a peripheral edge 28 of the mobile lid 12. The two tabs, top 20 and central 21, are both hinged at one end to the front face 17 of the internal body 15, while at the opposite end each has a gluing surface 26*a*, 27*a* suitable to be attached to the internal wall 13 of the mobile lid 12.

In the case shown here as an example, the gluing surfaces 26*a* and 27*a* of the top tab 20 and of the central tab 21 respectively, are suitable to be glued to two surfaces 26*b* and 27*b* provided on the internal wall 13 of the mobile lid 12.

In this way a kinematic mechanism of the articulated quadrilateral type is created, which defines the motion of the mobile lid 12.

In this form of embodiment, in the closed position, the tabs 20, 21 lie parallel on the same plane.

In order to pass from the closed position shown in FIGS. 1*a* and 2*a* to the open one (FIG. 2*b*) and the completely open one (FIGS. 1*b* and 2*c*), the mobile lid 12 completes a rotation-translation, moving initially in a substantially orthogonal direction to the front wall 19 of the containing body 11, and subsequently in a substantially orthogonal direction to its upper wall 25.

In the terminal position of the movement described above, that is, the completely open position, the surface of the top tab 20 fits with the upper face 14 of the internal wall 13 of the mobile lid 12, in an inclined condition with respect to the initial one. In this position, at least in correspondence to the peripheral edge 28, the mobile lid 12 rests against the front wall 19 of the containing body 11.

From FIGS. 1*b*, 2*b* and 2*c* it is obvious that, in the open and completely open positions, the mobile lid 12 remains inside the front bulk of the packet 10, a bulk defined by the shape of the containing body 11.

Figure 6B:
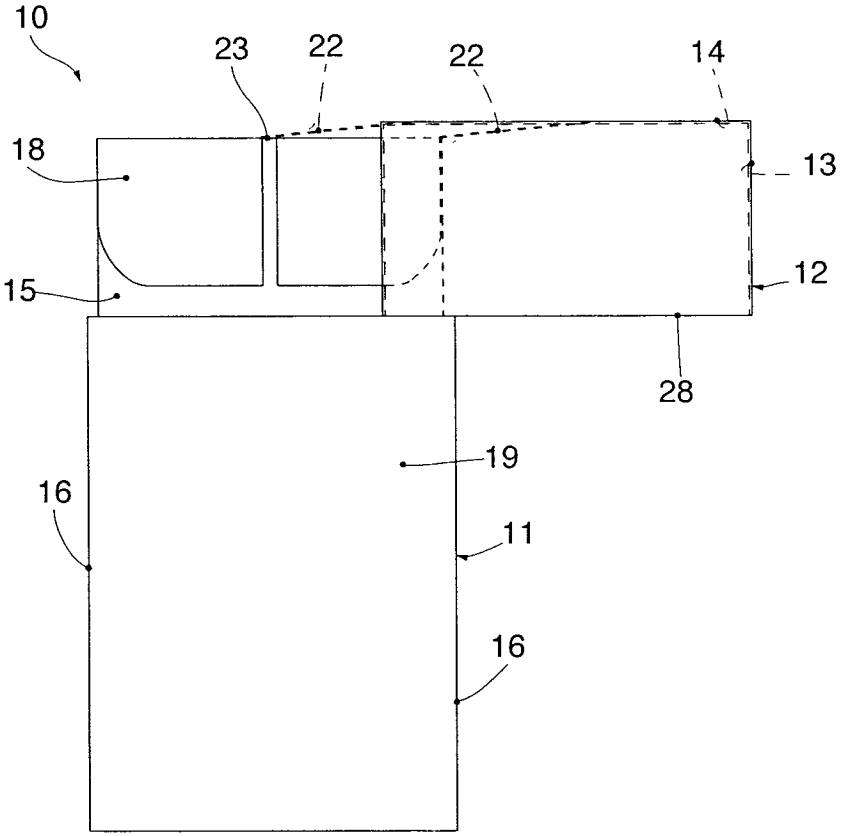
FIG. 6*b* is a front view of a variant of the solution in FIG. 2*c;*
Figure 6A:
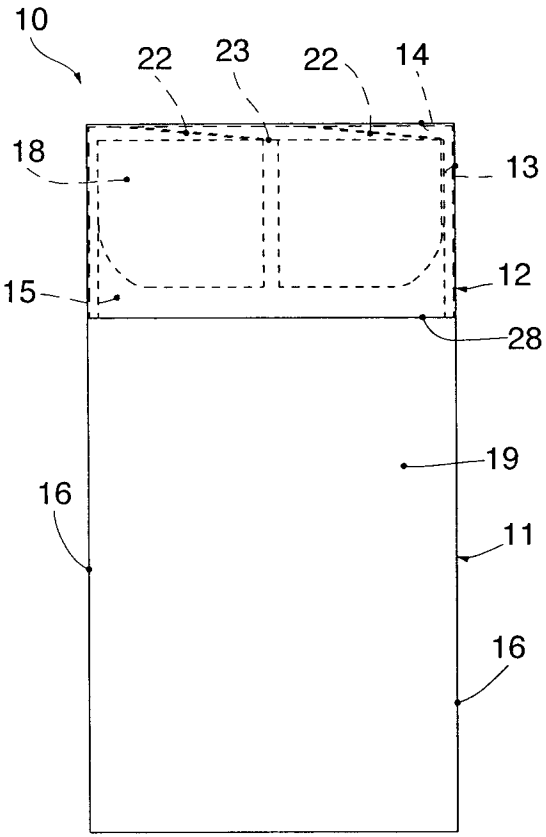
FIG. 6*a* is a front view of a variant of the solution in FIG. 2*a;*

According to a variant, shown in FIGS. 6*a* and 6*b*, the internal body 15 also comprises an upper wall 23, to which two tabs, referred to as upper tabs 22, are hinged at one end. Both have their other end hinged to the upper face 14 of the internal wall 13 of the mobile lid 12.

This disposition makes the mobile lid 12 move laterally, rather than frontally, from the closed position to the final, completely open position.

In this last position (FIG. 6*b*), in correspondence at least to one of its own peripheral edges 28, the mobile lid 12 rests on the front wall 19 of the containing body 11 and also remains around and in close proximity to the lateral bulk of the packet 10, a bulk defined by the shape of the containing body 11.

The elastic characteristics and the conformation of the tabs described above allow the mobile lid 12 to remain in the open position, until a further intervention by the user.

Figure 7B:
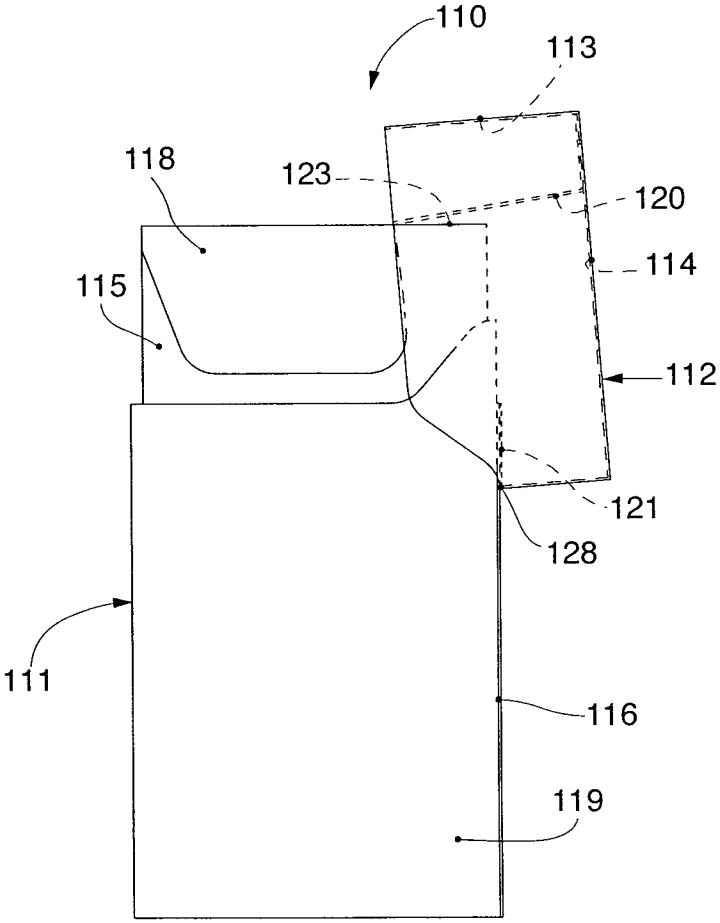
FIG. 7*b* is a front view of the packet in FIG. 7*a* in an open position.
Figure 7A:
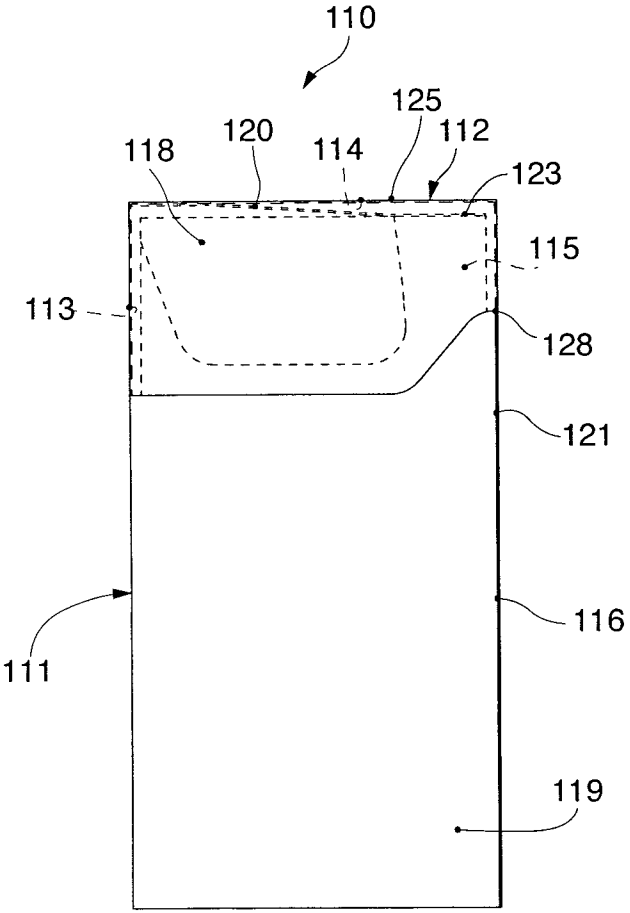
FIG. 7*a* is a front view of the packet in the closed position, according to a second form of embodiment.

With reference to FIGS. 7*a* and 7*b*, a packet 110 according to the present invention provides a second form of embodiment, in which the packet 110 comprises a containing body 111, an internal body 115 and a mobile lid 112, which comprises an internal wall 113, which in turn includes an upper face 114. In this example, a top tab 120 is hinged to an upper wall 123 of the internal body 115, while a central tab 121, made from a lateral wall 116 of the containing body 111, is hinged to the lateral wall 116. Both are also hinged to the upper face 114 of the internal wall 113 of the mobile lid 112.

In this case, in the closed position, the top tab 120 and central tab 121 lie on planes substantially orthogonal with respect to each other.

In order to pass from the closed position (FIG. 7*a*) to the open position (FIG. 7*b*), the mobile lid 112 first performs a rotational movement and then a rotation-translation movement laterally and downward.

In the open position, the mobile lid 112 rests against the lateral wall 116 in correspondence at least to its own peripheral edge 128 and is substantially rotated by 90° with respect to the initial closed position.

Figure 8B:
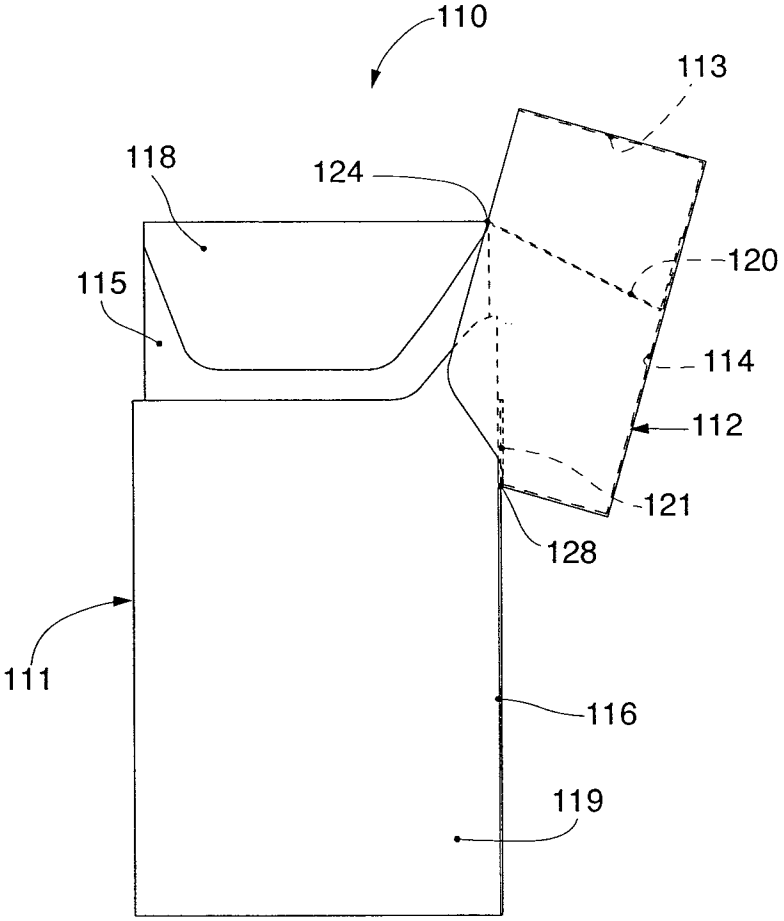
FIG. 8*b* is a front view of the packet in FIG. 7*b* according to a variant.
Figure 8A:
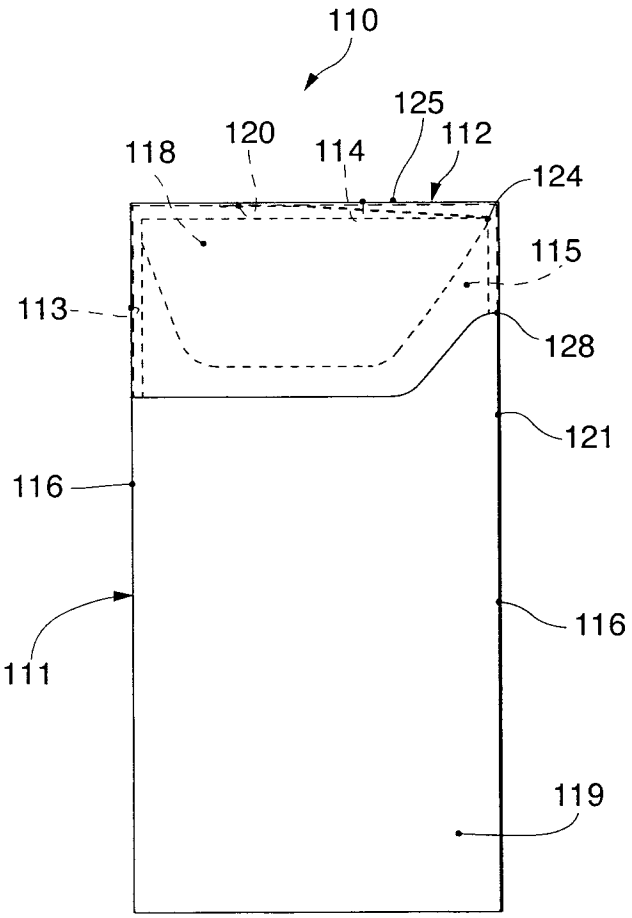
FIG. 8*a* is a front view of the packet in FIG. 7*a* according to a variant.

According to a variant, shown in FIGS. 8*a* and 8*b*, the top tab 120 is hinged to an upper edge 124 of the internal body 115, in this case to the right upper edge 124. The movement of the mobile lid 112 is analogous to that described above, except for the entity of the upper opening. This disposition allows the opening of all the upper part of the internal body 115, facilitating access to the material contained in the internal compartment of the packet 110.

In the open position, the mobile lid 112 is rotated by an angle of more than 90° with respect to the initial closed position and rests against the lateral wall 116 of the containing body 111 in correspondence to its own peripheral edge 128.

In this position, the mobile lid 112 remains around and in close proximity to the lateral bulk of the packet 110, a bulk defined by the shape of the containing body 111.

By way of example, we shall now describe the method to make the packet 10 shown in FIGS. 1*a* to 5.

With reference to FIG. 3, the containing body 11 and the mobile lid 12 are comprised inside a first blank 32. The folding and cutting lines and intended breakage lines needed to make the two elements described above are shown in the blank.

With reference to FIGS. 4 and 5, a second blank 33 allows to make the internal body 15. The folding and cutting lines needed to make the top tab 20 and central tab 21 described above are shown in the blank.

To make the packet 10 according to the present invention, first of all the first blank 32 is cut and shaped, inside which the internal body 15 is inserted, made from the shaping of the second blank 33. To facilitate comprehension of the folding method, in FIGS. 3 and 1*b* two corresponding lateral surfaces of the containing body 11 are identified with the letters A and B, respectively before and after folding.

The gluing surfaces 26*a* and 27*a*, belonging respectively to the top tab 20 and to the central tab 21, are then glued to the corresponding surfaces 26*b* and 27*b* comprised in the internal wall 13 of the mobile lid 12.

Finally, a break is made according to the line of intended breakage "XY" in the first blank 32, to define the definitive shape of the mobile lid 12, releasing it from the containing body 11.

According to the form of embodiment considered, at the end of this procedure, a protective wrapper 18 is inserted inside the cavity delimited by the containing body 11 and the internal body 15; the function of the protective wrapper 18 is to protect the product from contamination and/or damage deriving from external agents, above all in the steps before sale.

It is clear that modifications and/or additions of parts may be made to the packet 10, 110 and to the blanks 32, 33 as described heretofore, without departing from the field and scope of the present invention.

For example, at least a tongue may be introduced, made in the lateral wall of the internal body 15, suitable to couple with at least a seating for the tongue, made in the internal wall 13 of the mobile lid 12, starting from the first blank 32, in order to reinforce the closed position.

It is also clear that, although the present invention has been described with reference to some specific examples, a person of skill in the art shall certainly be able to achieve many other equivalent forms of packet or blanks, having the characteristics as set forth in the claims and hence all coming within the field of protection defined thereby.

The invention claimed is:

1. A packet for containing products, comprising:
a containing body having:
a first lateral wall and second lateral wall;
a rear wall;
a front wall;
an upper wall; and
a lower wall, wherein the walls define a front bulk and a lateral bulk;
a mobile lid movable between a closed position and an open position; and
a first tab and a second tab, wherein the first tab and second tab each connect the mobile lid to the containing body and are both hinged on the same wall of the containing body so that the tabs are substantially parallel when the mobile lid is in a closed position;
wherein the first tab is attached at an inside central position on the lid and the second tab is attached at an inside edge of the lid.

2. The packet of claim 1, wherein at least a peripheral part of the mobile lid contacts with the containing body when the mobile lid is at the closed position, and the mobile lid at the open position is at least partly lower than the mobile lid at the closed position.

3. The packet of claim 2, wherein the first tab and the second tab have different lengths.

4. The packet of claim 1, wherein the first tab and the second tab have the same lengths.

5. The packet of claim 1 further comprises an internal body disposed within the containing body.

6. A packet for containing products, comprising:
a containing body having four side walls, a top wall, and a bottom wall, wherein the containing body comprises an internal body having a front wall and two side walls, wherein the internal body is disposed within the containing body;
a mobile lid movable between a closed position and an open position; and
a first tab and a second tab, wherein the first tab and second tab each connect the mobile lid to the internal body and are both hinged on the same wall of the internal body so that the tabs are substantially parallel when the mobile lid is in a closed position;
wherein the first tab is attached at an inside central position on the lid and the second tab is attached at an inside corner of the lid.

7. The packet of claim 6, wherein at least a peripheral part of the mobile lid contacts with the containing body when the mobile lid is at the closed position, and the mobile lid at the open position is at least partly lower than the mobile lid at the closed position.

8. The packet of claim 6, wherein the internal body further comprises an upper wall, both the first tab and the second tab are hinged on the upper wall of the internal body.

* * * * *